US007090593B2

(12) United States Patent
Sullivan

(10) Patent No.: US 7,090,593 B2
(45) **Date of Patent: *Aug. 15, 2006**

(54) GOLF BALL WITH NON-CIRCULAR DIMPLES

(75) Inventor: Michael J. Sullivan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 36 days.

This patent is subject to a terminal disclaimer.

(21) Appl. No.: 10/789,288

(22) Filed: Feb. 27, 2004

(65) Prior Publication Data

US 2004/0219996 A1 Nov. 4, 2004

Related U.S. Application Data

(63) Continuation-in-part of application No. 10/338,379, filed on Jan. 8, 2003, now Pat. No. 6,709,349, which is a continuation of application No. 09/847,764, filed on May 2, 2001, now Pat. No. 6,569,038.

(51) Int. Cl.
*A63B 37/14* (2006.01)

(52) U.S. Cl. ..... 473/383; 473/378

(58) Field of Classification Search ..... 473/378–385
See application file for complete search history.

(56) References Cited

U.S. PATENT DOCUMENTS

| | | | | |
|---|---|---|---|---|
| 55,330 | A | 6/1866 | Robertson | 83/436.5 |
| 1,418,220 | A | 5/1922 | White | 473/384 |
| 1,656,408 | A | 8/1928 | Young | 473/383 |
| 1,681,167 | A | 8/1928 | Beldam | 473/383 |
| 4,787,638 | A | 11/1988 | Kobayashi | |
| 5,005,838 | A | 4/1991 | Oka | |
| 5,114,099 | A | 5/1992 | Gao | 244/130 |
| 5,470,076 | A | 11/1995 | Cadorniga | |
| 5,503,398 | A | 4/1996 | Lu | 473/384 |
| 5,536,013 | A | 7/1996 | Pocklington | 473/384 |
| 5,842,937 | A | 12/1998 | Dalton et al. | 473/384 |
| 6,010,442 | A | 1/2000 | Lemons et al. | 473/384 |
| 6,059,671 | A | 5/2000 | Asakura | 473/383 |
| 6,066,055 | A | 5/2000 | Nishino | 473/378 |
| 6,079,349 | A * | 6/2000 | Simpson | 114/363 |
| 6,162,136 | A | 12/2000 | Aoyama | 473/383 |
| 6,176,793 | B1 | 1/2001 | Sullivan et al. | 473/378 |
| 6,315,686 | B1 | 11/2001 | Barfield | 473/378 |
| 6,569,038 | B1 | 5/2003 | Sullivan | 473/383 |
| 6,749,525 | B1 * | 6/2004 | Aoyama | 473/383 |

FOREIGN PATENT DOCUMENTS

| | | |
|---|---|---|
| GB | 171528 | 11/1921 |
| GB | 2103939 | 3/1983 |
| WO | 00/48687 | 8/2000 |

* cited by examiner

OTHER PUBLICATIONS

Merriam-Webster Online Dictionary, www.m-w.com.*

*Primary Examiner*—Eugene Kim
*Assistant Examiner*—Alvin A. Hunter, Jr.
(74) *Attorney, Agent, or Firm*—Kristin D. Wheeler

(57) ABSTRACT

A golf ball has a substantially spherical outer surface comprised of a plurality of non-circular dimples. The dimples are formed by a plurality of lobes extending from a central hub, wherein each lobe is defined by a curved outer segment. The curved outer segments form at least a portion of the perimeter of the dimple. The dimples are comprised of at least four lobes. The dimples can also be comprised of a plurality of radiating arms emanating from a location proximate the hub of the dimple.

10 Claims, 9 Drawing Sheets

GOLF BALL WITH NON-CIRCULAR DIMPLES

CROSS REFERENCE TO RELATED APPLICATIONS

This application is a continuation-in-part of U.S. application Ser. No. 10/338,379, filed Jan. 8, 2003, now U.S. Pat. No. 6,709,349 which is a continuation of U.S. application Ser. No. 09/847,764, filed May 2, 2001, now U.S. Pat. No. 6,569,038.

FIELD OF THE INVENTION

The present invention relates to golf balls, and more particularly, to a golf ball having improved dimples.

BACKGROUND OF THE INVENTION

Golf balls generally include a spherical outer surface with a plurality of dimples formed thereon. Conventional dimples are circular depressions that reduce drag and increase lift. These dimples are formed where a dimple wall slopes away from the outer surface of the ball forming the depression.

Drag is the air resistance that opposes the golf ball's flight direction. As the ball travels through the air, the air that surrounds the ball has different velocities and thus, different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on the golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the layer stays attached further along the ball's outer surface. As a result, there is a reduction in the area of the wake, an increase in the pressure behind the ball, and a substantial reduction in drag. It is the circumference portion of each dimple, where the dimple wall drops away from the outer surface of the ball, which actually creates the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. The circumference portion of each dimple is important in optimizing this flow phenomenon, as well.

By using dimples to decrease drag and increase lift, almost every golf ball manufacturer has increased their golf ball flight distances. In order to optimize ball performance, it is desirable to have a large number of dimples, hence a large amount of dimple circumference, which are evenly distributed around the ball. In arranging the dimples, an attempt is made to minimize the space between dimples, because such space does not improve aerodynamic performance of the ball. In practical terms, this usually translates into 300 to 500 circular dimples with a conventional-sized dimple having a diameter that ranges from about 0.120 inches to about 0.180 inches.

When compared to one conventional-size dimple, theoretically, an increased number of small dimples will create greater aerodynamic performance by increasing total dimple circumference. However, in reality small dimples are not always very effective in decreasing drag and increasing lift. This results at least in part from the susceptibility of small dimples to paint flooding. Paint flooding occurs when the paint coat on the golf ball fills the small dimples, and consequently decreases the aerodynamic effectiveness of the dimples. On the other hand, a smaller number of large dimples also begin to lose effectiveness. This results from the circumference of one large dimple being less than that of a group of smaller dimples.

U.S. Pat. No. 4,787,638 teaches the use of grit blasting to create small craters on the undimpled surface of the ball and on the surface of the dimples. Grit blasting is known to create a rough surface. The rough surface on the land surface of the ball may decrease the aesthetic appearance of the ball. Furthermore, these small craters may be covered by paint flooding. U.S. Pat. Nos. 6,059,671, 6,176,793 B1, 5,470,076 and 5,005,838, GB 2,103,939 and WO 00/48687 disclose dimples that have smooth irregular dimple surfaces. These smooth irregular dimple surfaces, however, could not efficiently energize the boundary layer flow over the dimples.

One approach for maximizing the aerodynamic performance of golf balls is suggested in U.S. Pat. No. 6,162,136 ("the '136 patent), wherein a preferred solution is to minimize the land surface or undimpled surface of the ball. The '136 patent also discloses that this minimization should be balanced against the durability of the ball. Since as the land surface decreases, the susceptibility of the ball to premature wear and tear by impacts with the golf club increases. Hence, there remains a need in the art for a more aerodynamic and durable golf ball.

SUMMARY OF THE INVENTION

Accordingly, the present invention is directed to a golf ball with improved dimples. The present invention is also directed to a golf ball with improved aerodynamic characteristics. These and other embodiments of the prevent invention are realized by a golf ball comprising a spherical outer land surface and a plurality of dimples formed thereon. The dimples have a plurality of sub-dimples to energize the airflow over the dimpled surface. The undimpled land surface, therefore, may remain robust to prevent premature wear and tear. The sub-dimples may have a myriad of shapes and sizes and may be distributed in any pattern, concentration or location. The sub-dimples may have a concave configuration, convex configuration or a combination thereof.

In another aspect of the invention, the dimples may have radiating arms emanating from the center of the dimple or a location proximate the center, or from a hub. Preferably, the radiating arms are evenly distributed throughout the dimple.

The radiating arms may have a plurality of shapes. At least some of the radiating arms may selectively protrude into the land surface or undimpled surface of the ball to improve the airflow over the land surface of the ball.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
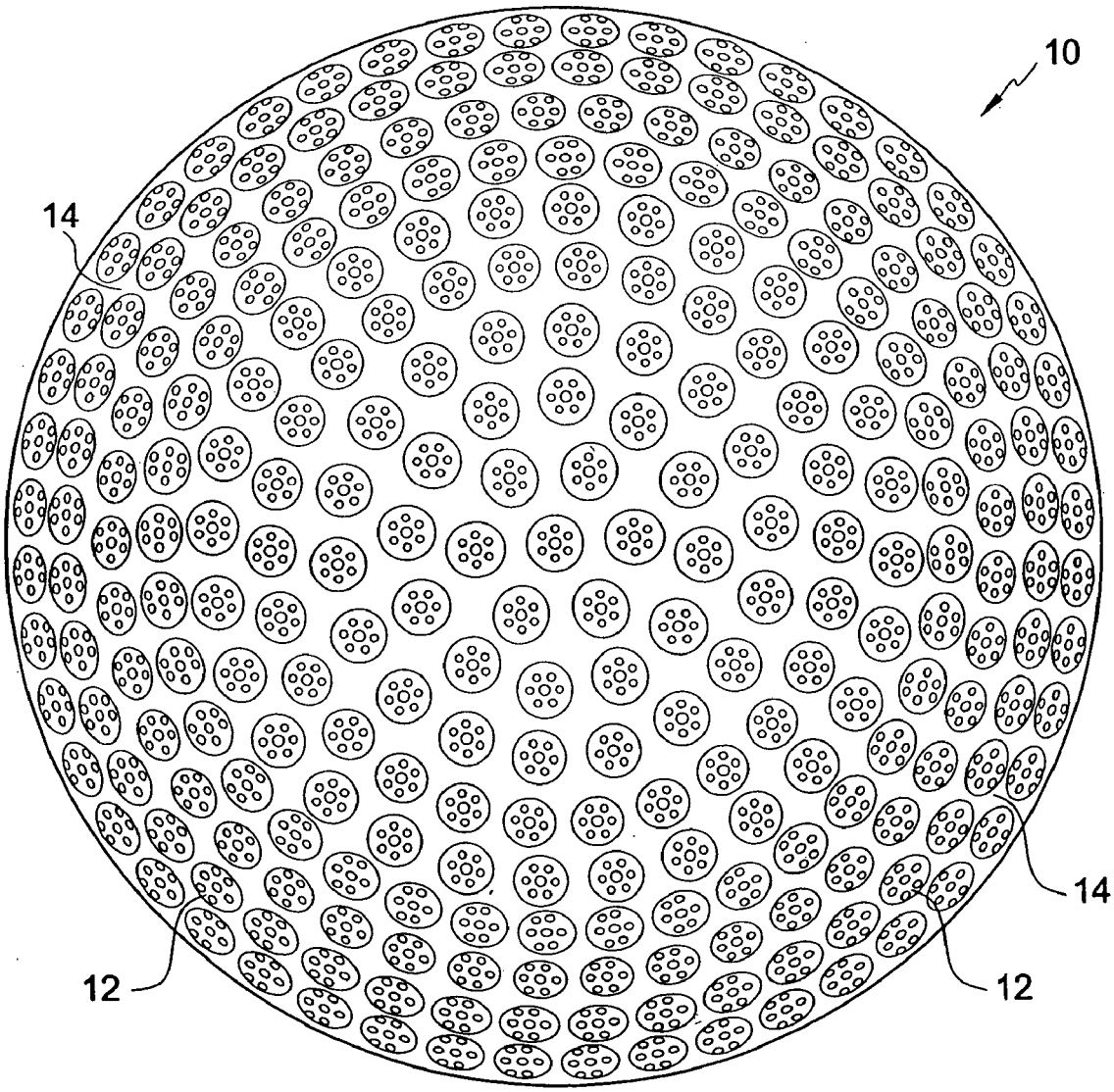
FIG. 1 is a front view of a preferred embodiment of a golf ball in accordance to the present invention.

As shown generally in FIG. 1, where like numbers designate like parts, reference number 10 broadly designates a golf ball 10 having a plurality of dimples 12 separated by outer undimpled or land surface 14.

In accordance to one aspect of the present invention, dimples 12 may have sub-dimples defined on thereon to further agitate or energize the turbulent flow over the dimples and to reduce the tendency for separation of the turbulent boundary layer around the golf ball in flight. As described below, the sub-dimples may have many shapes and sizes, as long as they contribute to the agitation of the air flowing over the dimples.

Figure 2A:
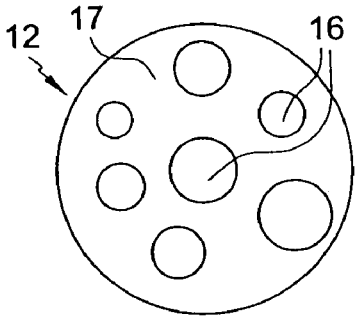
FIGS. 2*a*–2*i* are top views of the sub-dimple embodiments in accordance to the present invention.

FIGS. 2*a*–2*i* illustrate sub-dimples 16 disposed on the land surface 17 of the dimple 12. As used herein, the land surface 17 of the dimple 12 is the concave surface of the dimple unaffected by the sub-dimples or other sub-structures defined on the dimple. For spherical dimples, the land surface 17 is spherical or arcuate. The land surface may also be flat or may have any irregular shape known in the art. As taught in the '136 patent, the circumference of the dimples optimizes the aerodynamic performance of the golf ball. Similarly, the perimeter of the sub-dimples 16 also contributes to and improves the aerodynamic of the golf ball. Preferably, the size and depth of the sub-dimples are sufficiently large to minimize paint flooding. As shown in FIG. 2*a*, the distribution of the sub-dimples 16 may be random, and the size of the sub-dimples, may also vary. Advantageously, the sub-dimples of the present invention remedy a design issue known in the art, i.e., minimizing the land surface 14 of the golf ball for better aerodynamics but without increasing the wear and tear on the ball during repeated impacts by the golf clubs. In accordance to the present invention, the aerodynamic performance is increased by increasing the agitation of the boundary layer over the dimpled surfaces, and the land surface 14 may remain robust to resist premature wear and tear.

Figure 2B:
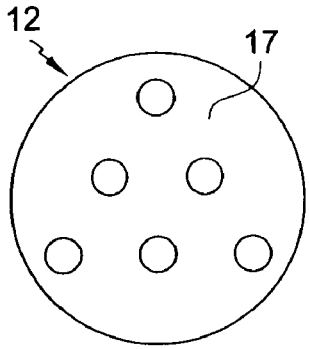
Figure 2C:
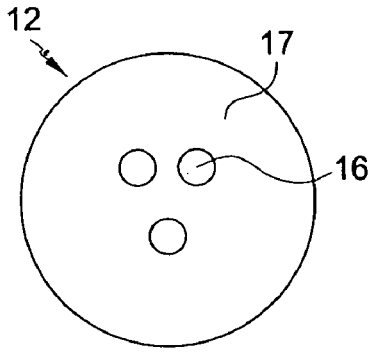
Figure 2D:
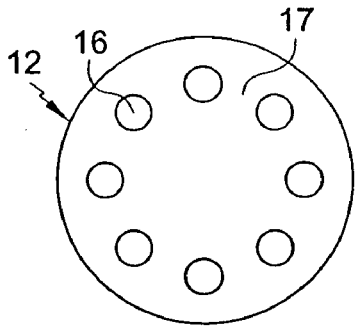
Figure 2E:
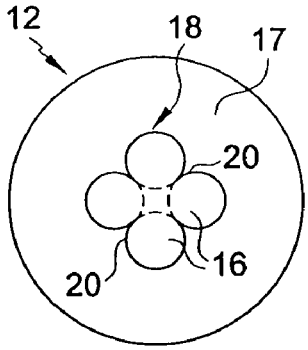

The sub-dimples 16 can assume a regular pattern, such as a triangular pattern shown in FIG. 2*b*. They may concentrate near the bottom of the dimple, as shown in FIG. 2*c*, or near the perimeter of the dimple, as shown in FIG. 2*d*. The sub-dimples may also abut or overlap each other. As shown in FIG. 2*e*, dimple 12 has cluster 18, which comprises four abutting sub-dimples 16. An advantage of the abutting distribu Sharp angles or other acute shapes are known to delay flow separation over an object in flight. The angles or shapes may be altered by repositioning one or more of the sub-dimples so that they overlap. Cluster 18 may be positioned at the bottom center of the dimple 12, as shown in FIG. 2*e*, or be disposed proximate to the perimeter of dimple 12. Additionally, dimple 12 may have more than one cluster 18, and cluster 18 may comprise any number of overlapping sub-dimples.

Figure 2F:
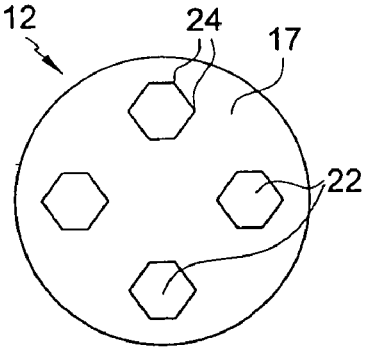
Figure 2G:
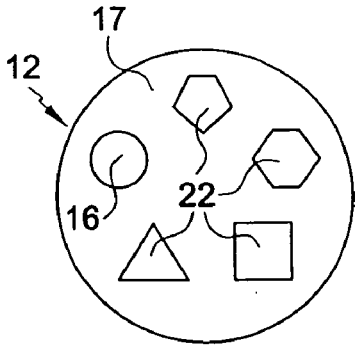
Figure 2H:
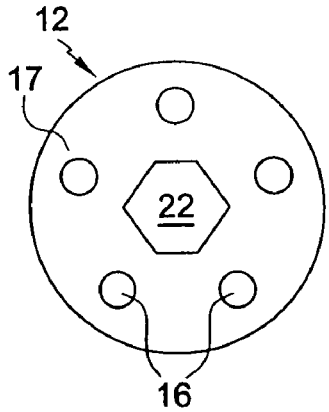
Figure 2I:
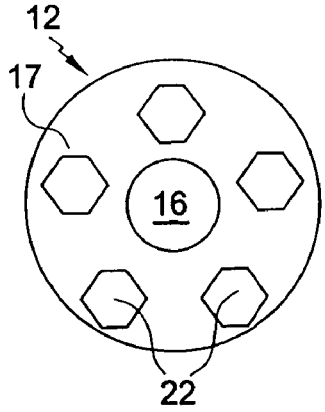

In accordance to another aspect of the invention shown in FIG. 2*f*, the sharp angle feature can be accomplished by polygonal sub-dimples 22 having a plurality of relatively sharp angles 24. FIG. 2*f* illustrates regular hexagonal sub-dimples 22. Other suitable polygonal shapes are shown in FIG. 2*g*. The sub-dimples in one dimple 12 may comprise polygonal sub-dimples 22, as well as circular sub-dimples 16 in any combination thereof, as illustrated in FIGS. 2*g*–2*i*.

When dimple 12 has a depth of about 0.010 inches from the land surface 14, a concave sub-dimple 16, 22 preferably has a depth from 0.0101 to 0.020 inches from the land surface 14 of ball 12. The sub-dimples may also be convex, i.e., protruding or upstanding from the land surface 17 of the dimple 12. A convex sub-dimple may protrude from 0.0001–0.010 inches from the arcuate land surface 17 of dimple 12. The sub-dimples may either be all concave or all convex, or be a mixture of concave and convex shapes. Preferably, most of the sub-dimples are concave. The sub-dimples can be arranged in any pattern, such as the ones shown in FIGS. 2*a*–2*i*, or in any pattern of golf ball dimples known in the prior art. In other words, the relatively small sub-dimples can be arranged within one dimple in any pattern similar to the patterns in which the relatively larger dimples are arranged on a golf ball.

Figure 3:
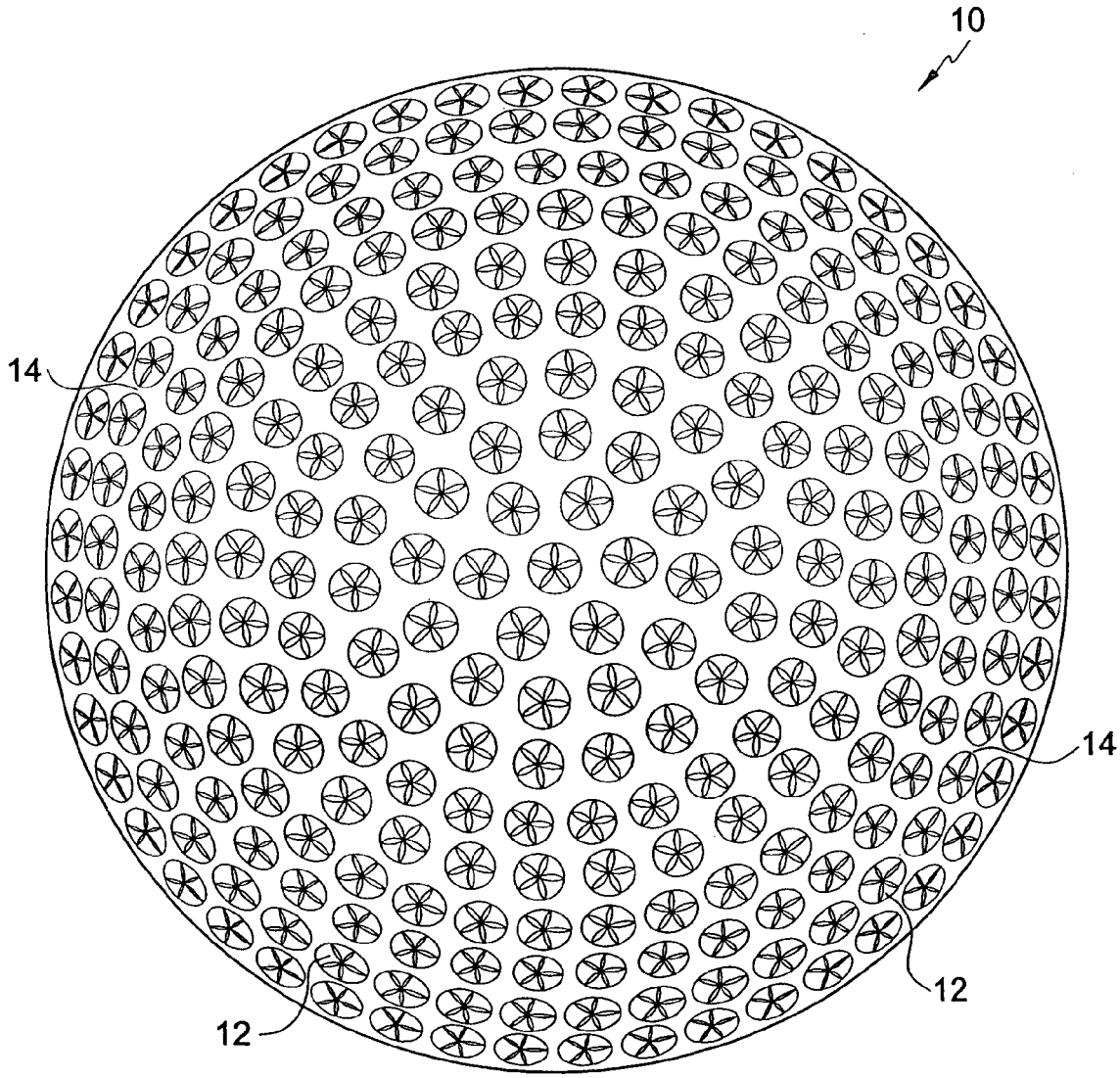
FIG. 3 is a front view of another preferred embodiment of the golf ball in accordance to the present invention.
Figure 3A:
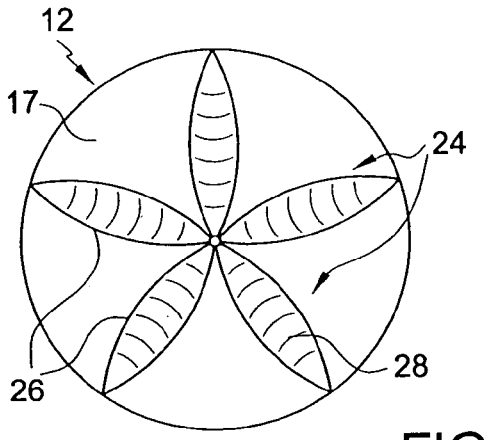
FIGS. 3*a*–3*e* are top views of the radiating arm dimple embodiments of the present invention.
Figure 3B:
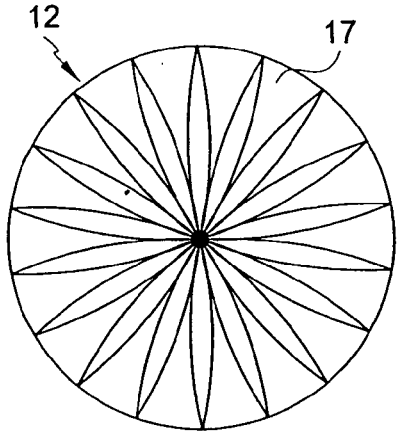

In accordance to another aspect of the invention shown in FIG. 3, the airflow across golf ball 10 can be energized and agitated by arms emanating from a location proximate to the center of the dimple. As shown FIG. 3*a*, dimple 12 comprises a plurality of radiating arms 24. Five arms are shown in FIG. 3*a*. However, any number of arms can be distributed within a single dimple as illustrated in FIG. 3*b*. Arms 24 may have a concave profile, i.e., the arms are carved from and are situated below the land surface 17 of dimple 12. For concave radiating arms, the perimeters 26 of the arms 24 energize the airflow over the dimples. Arms 24 may also have a convex profile, i.e., the arms are upstanding from land surface 17 of dimple 12, and are situated above the land surface 17. For convex radiating arms, the raised outer surfaces 28 of arms 24 energize the airflow over the dimples.

Figure 3C:
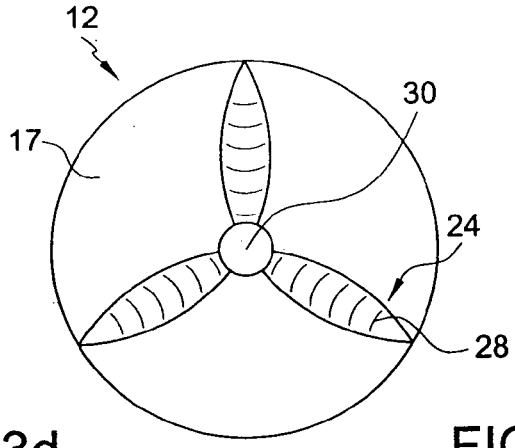
Figure 3D:
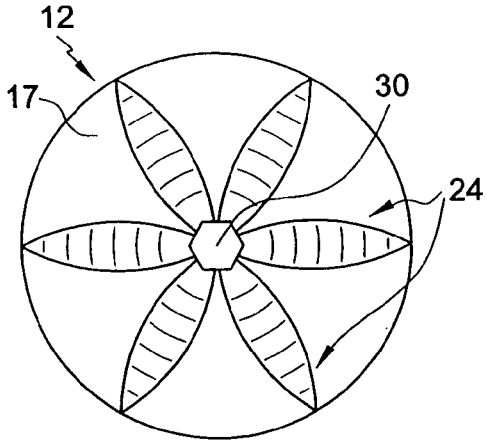
Figure 3E:
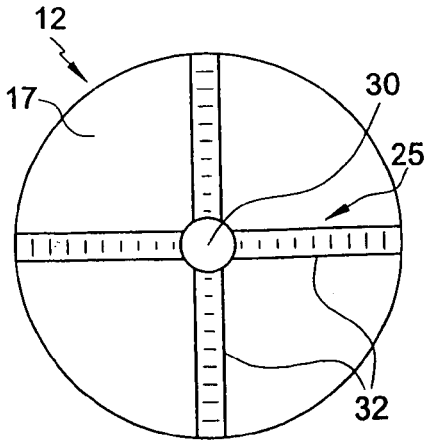

Alternatively, radiating arms 24 may emanate from a hub 30, as shown in FIG. 3*c*. Hub 30 may be protruding from the land surface 17 or may be a depression below land surface 17. Hub 30 may have a round profile, as shown in FIG. 3*c* or a polygonal profile, as shown in FIG. 3*d*. Advantageously, hub 30 also contributes to the agitation of the airflow over the dimples, either by its raised profile if it is convex, or by its perimeter if it is concave. If hub 30 has a concave shape, then it is structurally similar to a sub-dimple discussed above. Alternatively, while FIGS. 3*a*–3*d* show blade-shaped arms, radiating arms 25 shown in FIG. 3*e* may have substantially straight sides 32.

Figure 4A:
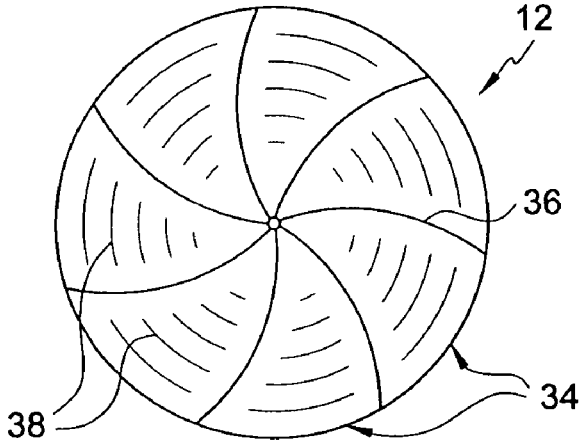
FIGS. 4*a*–4*c* are top views of the enlarging radiating arm embodiments of the present invention.
Figure 4B:
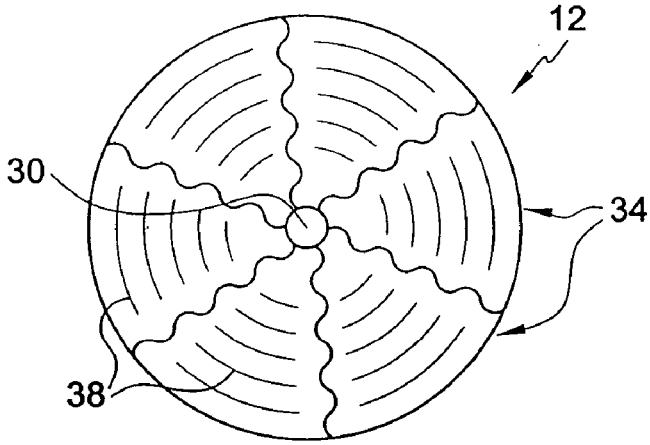

The radiating arms may also be enlarging in the radial direction. FIGS. 4*a* and 4*b* illustrate two examples of the enlarging radiating arm embodiment. Dimple 12 has a plurality of enlarging arms 34 radiating from the center or at a location proximate to the center of dimple 12. As arms 34 approach the perimeter of the dimple, their width gradually increases. Each arm is separated from one another by perimeter lines 36. As shown in FIG. 4*a*, perimeter lines 36 are curved, and as shown in FIG. 4*b* perimeter lines 36 are wavy. Alternatively, the perimeter lines can be straight, or they can be straight and extending in the radial direction. In the embodiment shown in FIGS. 4*a* and 4*b*, the arms 34 can either be convex or concave or a combination thereof. Advantageously, the dimple land area 17 has been eliminated in this embodiment so that the entire dimple surface is dedicated to energizing the airflow over the dimples. Similar to the previous embodiments, if the arms are concave the perimeter lines 36 would agitate the airflow over the dimples, and if the arms are convex, then the protruding surfaces 38 would agitate the airflow. Arms 34 may also radiating from hub 30.

Figure 4C:
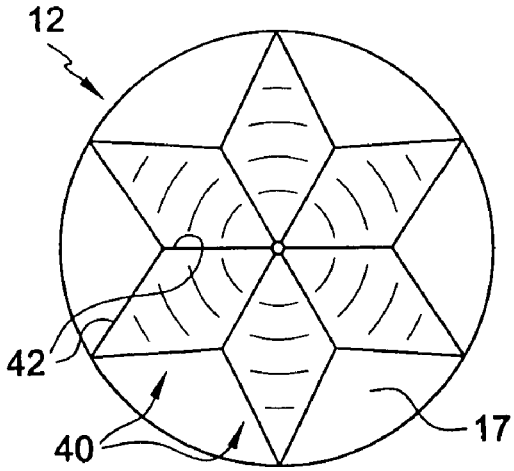

FIG. 4*c* shows a variation of the radiating arms. Radiating arms 40 have substantially a diamond shape. Generally, arms 40 are initially enlarged radially from the center of the dimple, and after reaching a predetermined maximum width the perimeter lines 42 approach each other and intersect at a location proximate to the lip of the dimple. The perimeter lines 42 can be substantially straight, as shown, or these lines may assume any non-linear configuration. In this particular embodiment, the land surface 17 of dimple 12 is limited to the outer periphery of the dimple.

Figure 5A:
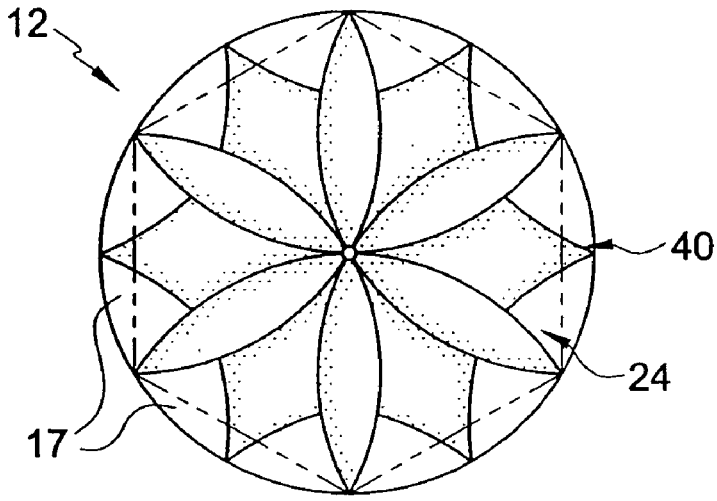
FIGS. 5*a*–5*b* are top views of alternating concave/convex arm embodiments of the present invention.

FIG. 5*a* is another embodiment of dimple 12 that combines elements from the previous embodiments. This dimple has a plurality of blade-shaped arms 24 and diamond shape arms 40 radiating from the center or a location proximate to the center of the dimple. Hub 30 may also be used. Optionally, the end points of blade shape aims 24 define a polygon (shown in phantom), and arms 40 do not extend beyond the perimeter of the polygon. In this embodiment, arms 24 may be concave while arms 40 are convex. Alternatively, arms 24, 40 can be either all concave or all convex or may have any combination of convex or concave shape.

Figure 5B:
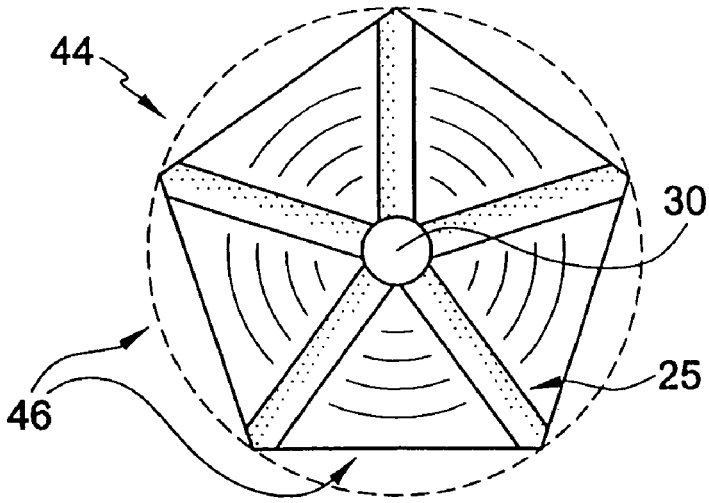

FIG. 5*b* is a variation of the embodiment of FIG. 5*a*. Here, non-circular dimple 44 comprises a plurality of substantially straight arms 25 emanating from an optional hub 30. Disposed between adjacent straight arms 25 is a polygonal, e.g., triangular, enlarging arm 46. Preferably, straight arms 25 may be concave and enlarging arms 44 may be convex. Alternatively, arms 25, 46 are either all convex or all concave, or may have any combination of convex or concave shape. Non-circular dimple 44 may optionally be enclosed within a circular dimple (shown in phantom), and the area between the perimeter of the circular dimple and the enclosed polygonal dimple 44 is preferably not affected by the radiating arms 25, 46. In other words, this area is similar to the land area 17 of dimple 12 previously described above.

Figure 6:
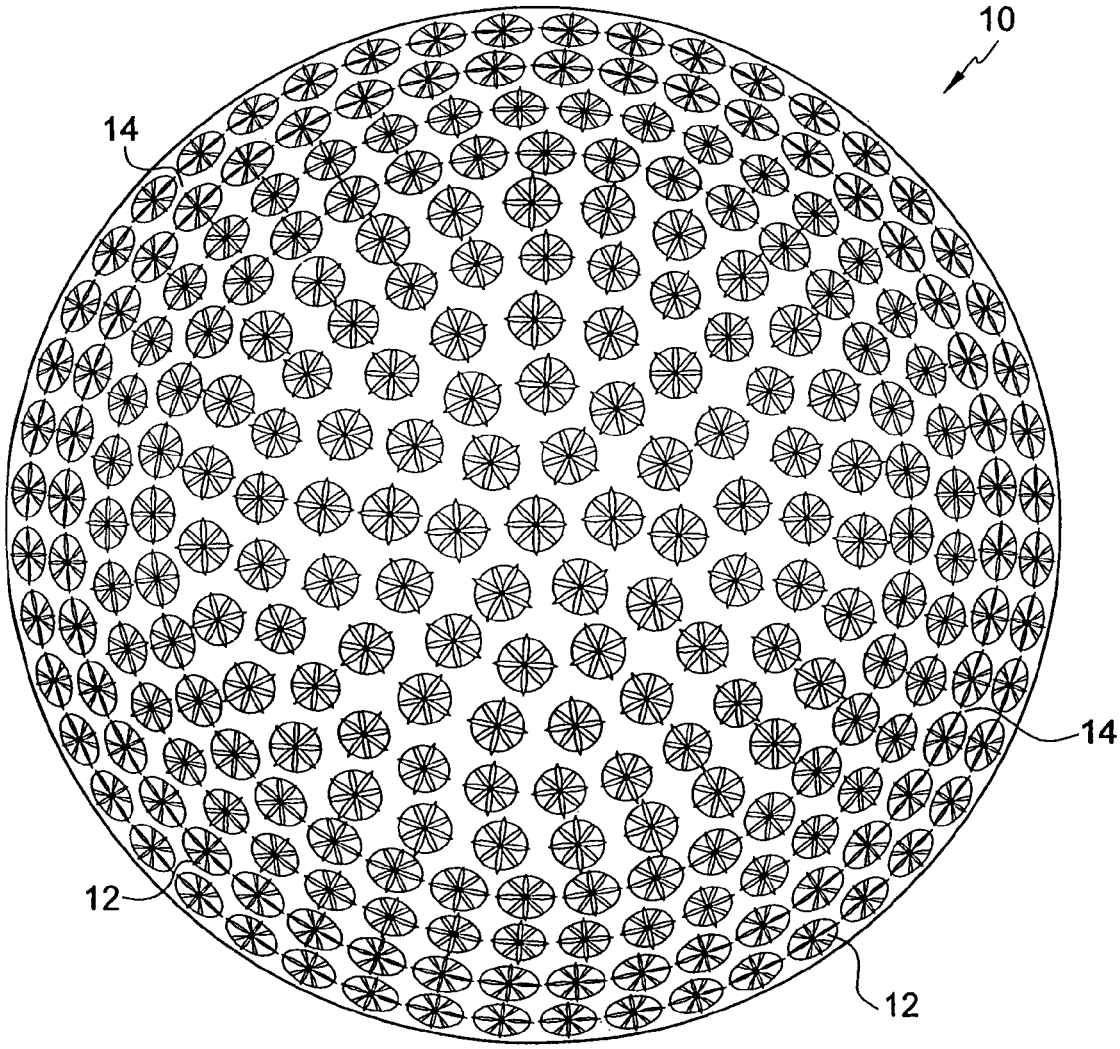
FIG. 6 is a front view of another preferred embodiment of the golf ball in accordance to the present invention.
Figure 6A:
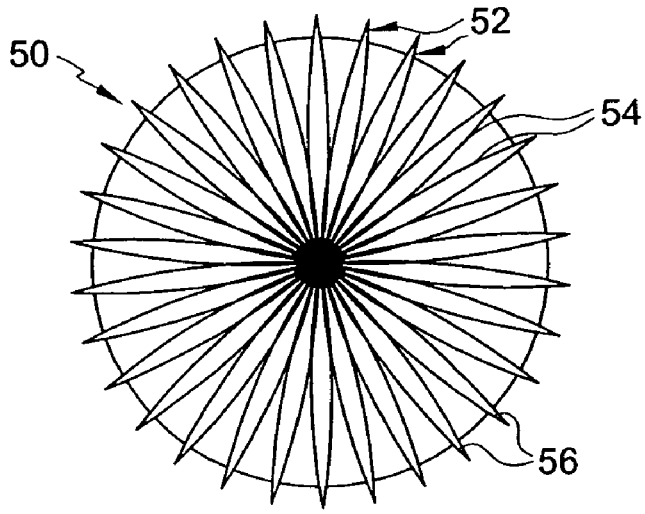
FIGS. 6*a*–6*b* are top views of protruding arm embodiments of the present invention.
Figure 6B:
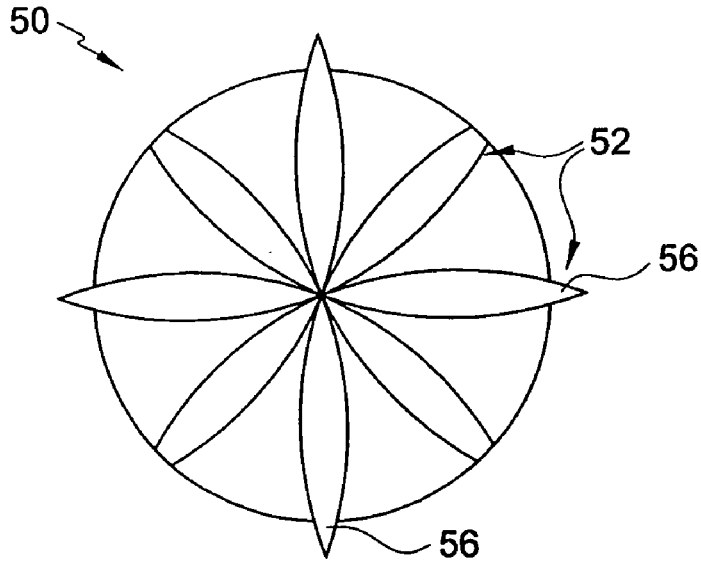

FIGS. 6, 6*a*, and 6*b* illustrate another aspect of the present invention. FIG. 6*a* shows a dimple 50, which has a plurality of arms 52 emanating from the center of the dimple or a location proximate the center. Arms 52 are similar in shape to blade shaped arms 24 described above, except that arms 52 protrude beyond the perimeter of dimple 50. Preferably, arms 52 have a concave configuration so that the perimeters 54 of the arms energize the airflow over the dimples. Advantageously, protruding portions 56 of arms 52 can additionally energize the airflow over the undimpled land surface 14 of the ball 10. The agitation of the airflow by the undimpled land surface 14 increases the aerodynamic performance of the golf ball.

FIG. 6*b* discloses another variation of dimple 50 where only some of the arms 52 have protruding portions 56, while the other arms 52 are truncated at the perimeter of the dimple. Preferably, the truncated arms alternate with the untruncated arms, as illustrated in FIG. 6*b*. Arms 52 may also radiate from a central hub 30. FIG. 6 illustrates a golf ball 10 with multiple dimples 50 shown in FIG. 6*b* disposed thereon.

Figure 7A:
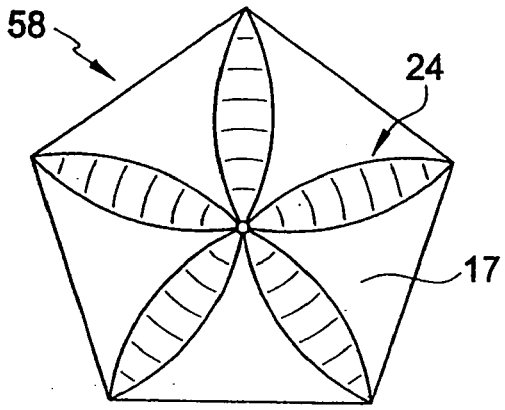
FIGS. 7*a*–7*d* are top views of non-circular dimple embodiments of the present invention.
Figure 7B:
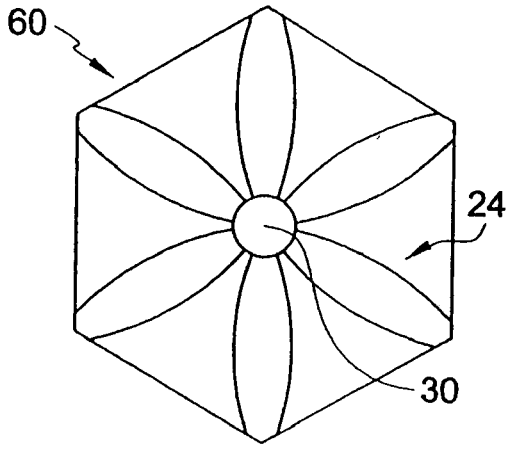
Figure 7C:
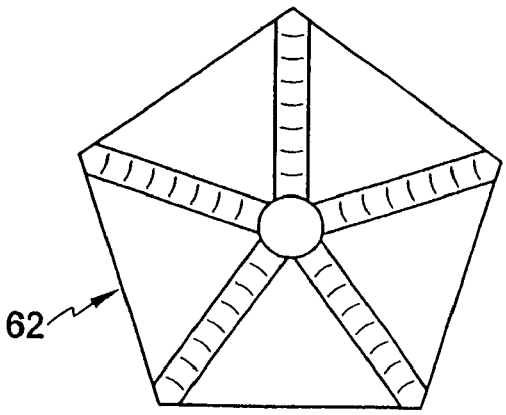
Figure 7D:
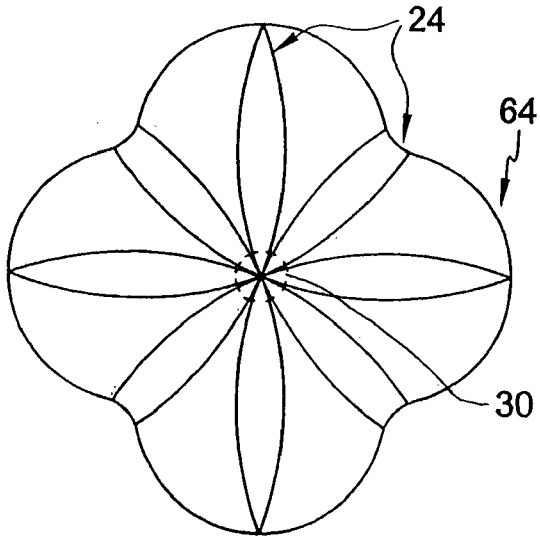

FIGS. 7*a*–7*d* illustrate some of the non-circular dimple embodiments in accordance to the present invention. FIGS. 7*a* and 7*b* show two polygonal dimple embodiments: pentagonal dimple 58 and hexagonal dimple 60, with arms 24 emanating from the center, from a location proximate to the center of the dimple, or from hub 30. Again, arm 24 can be either convex or concave, as described above. Advantageously, protruding arms 52 with protruding portion 56 can also be used in place of one or more arms 24 in the non-circular dimple embodiments. FIG. 7*c* is an example of a polygonal dimple 52, specifically a pentagonal dimple, with emanating substantially straight arms 25 disposed therein. FIG. 7*d* is an example of a non-circular dimple 64 with a plurality of arms emanating from the center of a location proximate the center. As shown, due to the irregularity of the perimeter of the dimple 64, some of the arms 24 may be truncated. Furthermore, protruding arms 52 may be used in place of one or more arms 24 in this embodiment.

As shown in FIG. 7*d*, the irregularity of the perimeter of dimple 64 is formed by a plurality of lobes. As illustrated, dimple 64 comprises four lobes, and each lobe is defined by a curved outer segment and bordered by two adjacent truncated radiating arms 24. Each lobe may also have an un-truncated arm 24 emanating from a location proximate the cenrer of the dimple to an apex point of the curved outer segment. Also, the locations on the perimeter where the curved outer segments of the lobes abut may also be rounded or smooth, as shown in FIG. 7*d*.

The use of sub-dimples 16, 22 or radiating arms 24, 25, 34, 40, 52, etc. in accordance to the present invention advantageously render golf balls with lower percentage of dimple coverage more aerodynamically desirable. More preferably, the sub-dimples are suitable for use with golf balls having greater than 60% or most preferably greater than 70% of dimple coverage.

The dimpled golf ball in accordance to the present invention can be manufactured by injection molding, stamping, multi-axis machining, electrodischarge machining ("EDM") process, chemical etching and hobbing, among others.

While various descriptions of the present invention are described above, it is understood that the various features of the embodiments of the present invention shown herein can be used singly or in combination thereof. For example, the sub-dimples 16, 22 can be used in combination with the radiating arms 24, 25, 34, 40, 52 within a single dimple. This invention is also not to be limited to the specifically preferred embodiments depicted therein.

What is claimed is:

1. A golf ball comprising an outer surface with a plurality of non-circular dimples, the dimples are formed by a plurality of lobes, wherein each lobe is defined by a curved outer segment and the curved outer segments form at least a portion of the perimeter of the dimple, wherein at least one radiating arm is located within each lobe.

2. The golf ball of claim 1, wherein the dimples are comprised of at least four lobes.

3. The golf ball of claim 1, wherein the at least one radiating arm emanates from a location proximate the center of the dimple.

4. The golf ball of claim 3, wherein each lobe is further defined by two radiating arms.

5. The golf ball of claim 4, wherein the radiating arms include truncated radiating arms.

6. The golf ball of claim 1, wherein the lobes extend from a central hub.

7. The golf ball of claim 1, wherein the central hub has a round profile.

8. The golf ball of claim 7, wherein the central hub has a convex profile.

9. The golf ball of claim 7, wherein the central hub has a concave profile.

10. The golf ball of claim 1, wherein the at least one radiating arm extends to an apex point of the lobe.

* * * * *